US007504062B2

(12) United States Patent
Löcher et al.

(10) Patent No.: US 7,504,062 B2
(45) **Date of Patent: *Mar. 17, 2009**

(54) METHOD AND DEVICE FOR PRODUCING A SPUNBONDED NONWOVEN FABRIC

(75) Inventors: Engelbert Löcher, Worms (DE); Michael Heβ, Trippstadt (DE)

(73) Assignee: Carl Freudenberg KG, Weinheim (DE)

( * ) Notice: Subject to any disclaimer, the term of this patent is extended or adjusted under 35 U.S.C. 154(b) by 811 days.

This patent is subject to a terminal disclaimer.

(21) Appl. No.: 10/196,836

(22) Filed: Jul. 16, 2002

(65) Prior Publication Data

US 2003/0030175 A1 Feb. 13, 2003

(30) Foreign Application Priority Data

Jul. 16, 2001 (DE) ..... 101 33 790

(51) Int. Cl.
*D04H 3/05* (2006.01)

(52) U.S. Cl. ..... 264/555; 19/163; 28/102

(58) Field of Classification Search ..... 264/555; 226/7, 97.1; 19/160, 163; 28/102
See application file for complete search history.

(56) References Cited

U.S. PATENT DOCUMENTS

| | | | | |
|---|---|---|---|---|
| 3,030,659 | A * | 4/1962 | Slayter | 65/514 |
| 3,293,718 | A | 12/1966 | Sheets | |
| 3,485,428 | A * | 12/1969 | Jackson | 226/97.4 |
| 3,720,361 | A | 3/1973 | Nommensen | |
| 4,099,296 | A * | 7/1978 | Gustavsson | 19/304 |
| 4,285,452 | A | 8/1981 | Reba et al. | |
| 5,075,068 | A * | 12/1991 | Milligan et al. | 264/555 |
| 5,211,903 | A * | 5/1993 | Reifenhauser | 264/555 |
| 5,312,500 | A * | 5/1994 | Kurihara et al. | 156/62.4 |
| 5,695,377 | A | 12/1997 | Triebes et al. | |
| 5,762,857 | A * | 6/1998 | Weng et al. | 264/465 |
| 6,524,521 | B1 * | 2/2003 | Kuroiwa et al. | 264/555 |
| 6,887,331 | B2 * | 5/2005 | Locher et al. | 156/167 |

FOREIGN PATENT DOCUMENTS

| | | |
|---|---|---|
| DE | 2114854 | 10/1971 |
| DE | 1760812 | 3/1972 |
| DE | 1 303 556 | 5/1972 |
| DE | 24 21 401 | 11/1975 |
| DE | 2742068 | 4/1978 |
| DE | 35 42 660 | 6/1987 |
| DE | 39 07 215 | 11/1989 |
| EP | 1081262 | 3/2001 |
| GB | 1219921 | 1/1971 |
| JP | B 50-20635 | 3/1975 |
| JP | A 62-162063 | 7/1987 |
| JP | A 62-223361 | 10/1987 |
| JP | A 2001-140159 | 5/2001 |
| WO | WO92/07122 | 4/1992 |
| WO | WO97/05306 | 2/1997 |

* cited by examiner

*Primary Examiner*—Mark A Osele
(74) *Attorney, Agent, or Firm*—Kenyon & Kenyon LLP

(57) ABSTRACT

A method and apparatus for the production of a spunbonded nonwoven fabric, by spinning a linear filament sheet of filaments arranged parallel next to one another, in the form of a curtain, from a plurality of spinning capillaries, with aerodynamic take-off and stretching of the filament sheet, where the filament sheet (8) that exits from the stretching channel (12) or is drawn off a spool is moved laterally, crosswise, by an air stream, the direction of which changes periodically, where the air stream is alternately directed at a slant to the filament sheet (8), seen in the horizontal plane.

13 Claims, 5 Drawing Sheets

METHOD AND DEVICE FOR PRODUCING A SPUNBONDED NONWOVEN FABRIC

BACKGROUND OF THE INVENTION

1. Field of the Invention

The invention relates to methods and devices suitable for the production of spunbonded nonwoven fabrics.

2. Description of Related Art

The starting materials used are thermoplastic polymers that are melted and spun into fine spun filaments. The spun filaments are generally stretched aerodynamically and thereby obtain the desired strength. The filaments are deposited after the spinning process, or also after having first been placed on spools, on a deposit belt on which they come to lie on top of one another, forming the spunbonded nonwoven fabric.

The spinning process can also take place using the melt-blown process, in which the melt exiting from the spinnerets is entrained by an air stream at high pressure and high temperature, so that fibers with a low thickness are formed. These fibers can also be deposited to form a nonwoven fabric, and this is done primarily on deposit drums.

A process for the production of nonwoven fabrics is known from German Patent AS 1 303 556, in which the spun filaments are passed through a channel, aerodynamically stretched there, and subsequently deposited on a perforated, moving substrate, in the form of a nonwoven fabric. In order to ensure that the filaments are deposited in statistically random manner, a turbulence zone is provided below the air guide channel, which supports the filaments in being laid across one another. A very irregular pattern of the nonwoven fabric is obtained. A high degree of uniformity of the spunbonded nonwoven fabric is achieved in that several guide channels are provided, one after the other, and in that the filament sheets that exit from them are deposited in layers, on top of one another, to form the nonwoven fabric.

In order to be able to determine the desired uniformity of the nonwoven fabric and its strength in the lengthwise or crosswise direction, it is known from German Patent 39 07 215 A1 to structure the spinning manifolds as well as the filament take-off device so as to rotate. In this way, the disadvantages that occur in the so-called curtain method and that can lead to superimposition of individual filaments in certain regions are also supposed to be eliminated. In the curtain method, the nonwoven fabric has a preferential strength in the lengthwise direction, i.e. in the production direction, while the strength values in the crosswise direction are lower. This is supposed to be evened out by slanting the spinning manifolds along with the deposition and stretching device.

It is also known from German Patent 35 42 660 C2 to achieve deflection of the air stream, using a pivoting device arranged in parallel, below the take-off channel, in order to achieve a pendulum motion of the filaments in this way. The pivoting movement takes place in the running direction of the deposit belt in the production direction; among other things, so-called Coanda shells can be used, as they are described in German Patent 24 21 401 C3, for example. However, the measures provided are relatively sluggish, so that only slow oscillation of the filament sheet is possible. Uniform deposition is particularly difficult for fibers produced using the melt-blown method.

SUMMARY OF THE INVENTION

It is an object of the invention to provide a method and a related device for the production of a spunbonded nonwoven fabric, with which a very great uniformity of the nonwoven fabric structure and surface weight distribution can be achieved. It is a further object of the invention to provide such a method and device which make it possible to produce the lengthwise or crosswise strength of the nonwoven fabric in a pre-determined manner, for example, wherein the strength in the crosswise direction is supposed to be as great as the strength in the lengthwise direction.

These and other objects of the invention are achieved by a method and apparatus for the production of a spunbonded nonwoven fabric, by spinning a linear filament sheet of filaments arranged parallel next to one another, in the form of a curtain, from a plurality of spinning capillaries, with aerodynamic take-off and stretching of the filament sheet, wherein the filament sheet (8) that exits from the stretching channel (12) or is drawn off a spool is moved laterally, crosswise, by an air stream having periodically changing directions, the air stream being alternately aligned at a slant to the filament sheet (8), seen in the horizontal plane. The apparatus includes a spinning manifold having a plurality of spinning capillaries that lie in a row, a cooling air shaft and a stretching channel, a deposit belt, and at least one blowing shaft (3) arranged below the stretching channel (12), in front of and/or behind the filament sheet (8), with air exit nozzles (10, 11) that are aligned at a slant towards the filament sheet (8), seen in the horizontal plane.

BRIEF DESCRIPTION OF DRAWINGS

The invention will be described in greater detail with reference to the following drawings wherein.

DETAILED DESCRIPTION OF THE INVENTION

Figure 1:
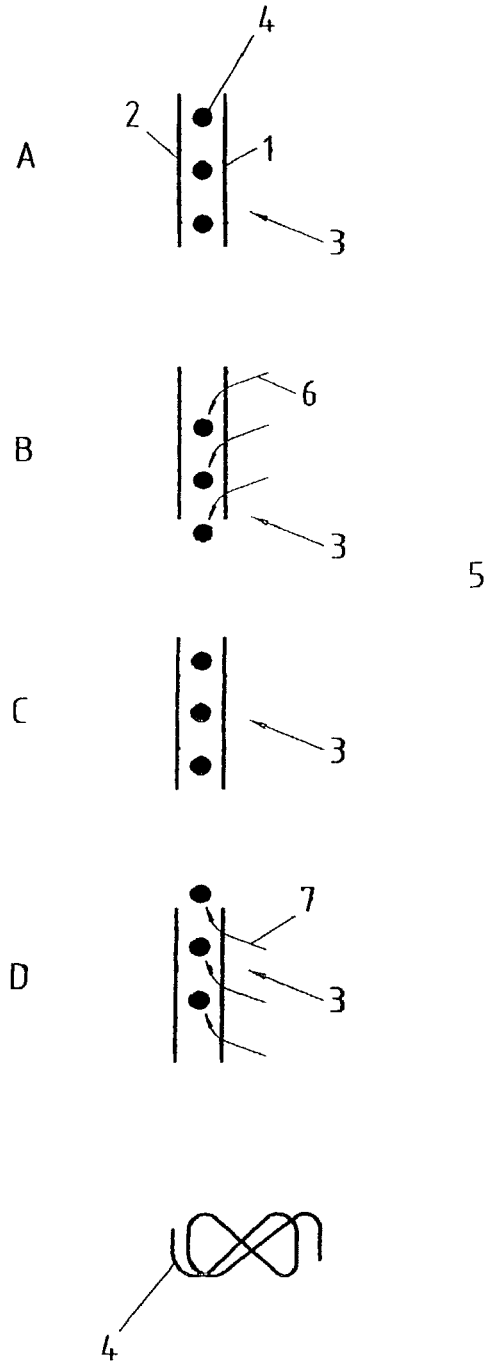
FIG. 1 shows the sequence of the method, schematically.

According to the invention, the filament sheet that exits from the stretching channel or is drawn off a spool, or the fibers spun using the melt-blown method, is/are moved laterally, crosswise, by an air stream, with the direction changing periodically, where the air stream is directed alternately at a slant to the filament sheet or the fibers, viewed in the horizontal plane. Individual air blasts in alternating directions have the effect that the filament sheet or the fibers is/are moved back and forth crosswise to the production direction, resulting in the intended nonwoven fabric structure, for a example a high degree of uniformity in the structure.

The air streams can be applied alternately from the left and the right. It proved to be advantageous if air-free breaks are inserted between the individual air streams, during which no air blast is present, allowing the filament sheet or fibers to be directed vertically between air blasts.

The general blowing direction of the air streams is directed perpendicular to the filament sheet or fibers. In this connection, a blowing angle in the horizontal plane of 15° is selected. Other blowing angles are also possible, of course, as needed. It is also possible that the blowing direction is directed at a slant downwards onto the filament sheet or fibers, in the vertical plane. The blowing angle in the vertical plane can be 15°.

It is sufficient if the air streams are directed onto the filament sheet or fibers from the front. However, this does not preclude the possibility that the air stream can also be directed onto the filament sheet or the fibers from the rear or from both the front and the rear. Among other things, this is dependent on the thickness of the individual filaments or fibers, and on the flow conditions that exist for the air blasts. If necessary, the deposition process can be additionally supported by flow guide surfaces that are moved periodically, such as pivot flaps, Coanda shells, or the like. As already known in the state of the art, these are arranged so that they additionally pivot the filament sheet or the fibers back and forth in the production direction.

The device for implementing the process includes a spinning manifold with a plurality of spinning capillaries that lie in a row, with a cooling air shaft and a stretching channel, and a deposit belt. According to the present invention, at least one blowing shaft is arranged below the stretching channel, in front of and/or behind the filament sheet, with air exit nozzles that are directed at a slant towards the filament sheet, seen in the horizontal plane. In the melt-blown method, the blowing shaft is arranged with the air exit nozzles below the spinnerets. The air blown in has a cooling effect on the fibers, and this is advantageous for the spinning process. The air exit nozzles are arranged in such a way that they can alternately blow an air stream in different directions, specifically from the left or the right, in a view onto the filament sheet or fibers. In this connection, it is advantageous if at least two rows of air exit nozzles, arranged parallel to one another, are provided, where the nozzles of one row are directed opposite the nozzles of the other row. The air feed to the nozzles takes place one after the other, so that one time, the air is applied to the nozzles towards the left, and another time, to the nozzles towards the right. For this purpose, the air feed to the nozzles of one row is shut off by a closure, in each instance. However, it is also possible to provide the nozzles themselves with closures, and to close off the nozzles of one row, in each instance, and to open the other row.

A rotating roller can be provided for closing off the nozzles; this roller is hollow in structure and is provided with lengthwise slits.

The nozzles can be formed by inserts in the form of corrugated sheet metal, with corrugations that run at a slant to their lengthwise direction, which are placed into the nozzle wall. They are preferably replaceable, so that the volume flow that passes through, or the flow direction, or its angle, can be easily changed.

The nozzle wall is provided with lengthwise slits that lie one above the other, which correspond to the lengthwise slits in the roller. A particularly advantageous embodiment provides for arranging an air storage chamber in the blowing shaft, which space is arranged between the nozzle wall and a sealing wall that rests against the roller. In this way, very uniform activation of the nozzles is achieved.

The air storage chamber is divided into two chambers by a sheet metal partition; these chambers are assigned to the upper and lower lengthwise slits of the sealing wall and the upper and lower nozzles in the nozzle wall, respectively. In this connection, the roller itself is arranged on a lengthwise channel that is filled with compressed air, which channel is connected with the compressed air supply.

The rotating roller has the advantage that even in the case of large production widths, a uniform pressure is applied to the nozzles over the entire production width.

The blowing angles of the nozzles of both rows of nozzles are preferably the same, which means that the same layout of the filament sheet or fibers is achieved in both directions. The blowing angles are 10 to 60°, preferably 45°.

To further support the nonwoven fabric laying process, an adjustable mechanical air guide can be provided below the blowing shaft, to control the direction of the air flow. This air guide can be made up of pivoting flaps or also of Coanda shells, by which the filament sheet can be moved back and forth in the production direction.

To support the air guide, the preferred embodiment provides that an air guide plate be attached opposite the blowing shaft, on the other side of the filament sheet or the fibers, which plate is adjustable in the blowing shaft direction. The direction of the lateral air flow is supported by this air guide plate, and the lateral pivoting movement of the filament sheet or the fibers can be adjusted to be stronger or weaker, in that the air guide plate is moved closer to the blowing shaft or moved away from it.

FIG. 1 schematically shows four individual steps, A, B, C, and D of the method, using the example of a filament sheet made up of endless filaments. Vertical lines 1 illustrate the front walls of a blowing shaft 3. An air guide plate is referred to as 2. Points 4 are supposed to show the individual filaments of the filament sheet. Arrow 5 shows the direction of movement of the deposit belt. Bent arrows 6 and 7 indicate the flow direction of the air stream.

In the method chosen for the example, the filament sheet made up of filaments 4 is moved first to the right, see Step B, and then to the left, see Step D, viewed in the production direction. Between these movements, the air flow is stopped, so that the filament sheet can be aligned vertically, as shown in Steps A and C. The air is blown out of blowing shaft 3, which is at the rear of the filament sheet, viewed in the production direction, out of the nozzles provided for that purpose, first from the right, see step B, and then from the left, see Step D. At the front of the filament sheet there is air guide plate 2, which is provided with an adjustment mechanism, so that its distance from blowing shaft 3 can be adjusted.

At the bottom of the figure, deposition of an individual filament 4 is shown, and it is evident that filament 4 performs a movement, during the course of being laid, that is approximately a figure eight.

Figure 2:
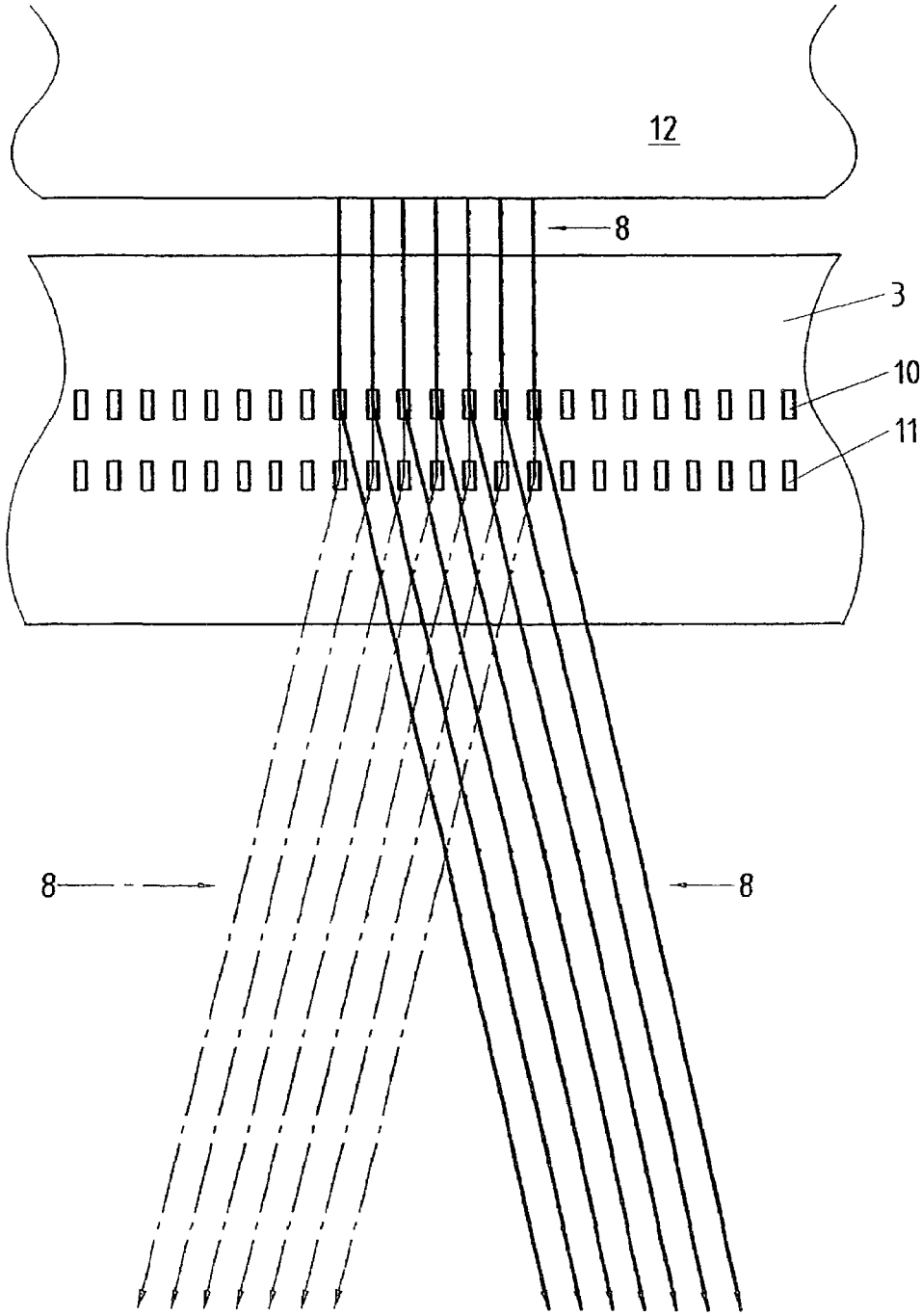
FIG. 2 shows the blowing shaft with the deflected filament sheet, schematically.

FIG. 2 shows blowing shaft 3 with air exit nozzles 10 and 11, located above one another in rows. Filament sheet 8 that exits from stretching channel 12 is first deflected to the right by the air stream that exits from nozzles 10, as indicated by the solid lines of filament sheet 8. After the air stream is taken away, filament sheet 8 aligns vertically again, and in the next step, it is deflected in the opposite direction by the air stream from air exit nozzles 11, as indicated by the dot-dash lines of filament sheet 8. It should be noted that this representation only shows the principle of the method schematically.

Figure 3:
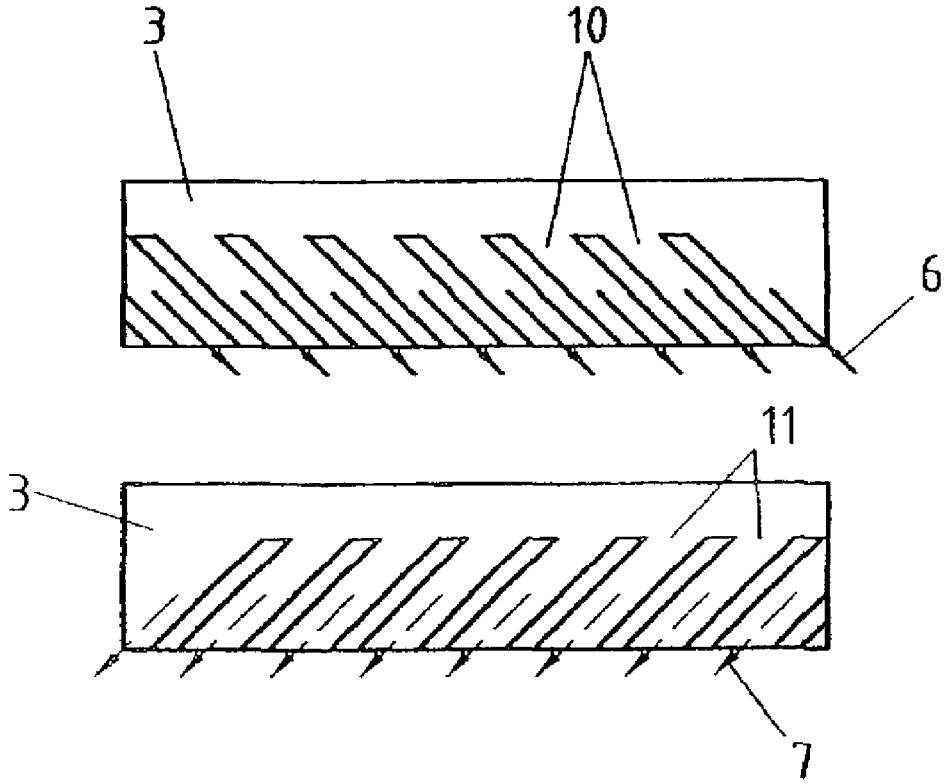
FIG. 3 shows air exit nozzles of the blowing shaft, in a top view.

FIG. 3 shows nozzles 10 and 11 of blowing shaft 3, in a top view. Arrows 6 and 7 indicate the flow direction of the air flow. Blowing shaft 3 is equipped with a sheet-metal partition that separates the spaces for nozzles 10 and 11, in each instance, from one another. In this way, it is possible to separately supply each space of blowing shaft 3 with compressed air.

Figure 4:
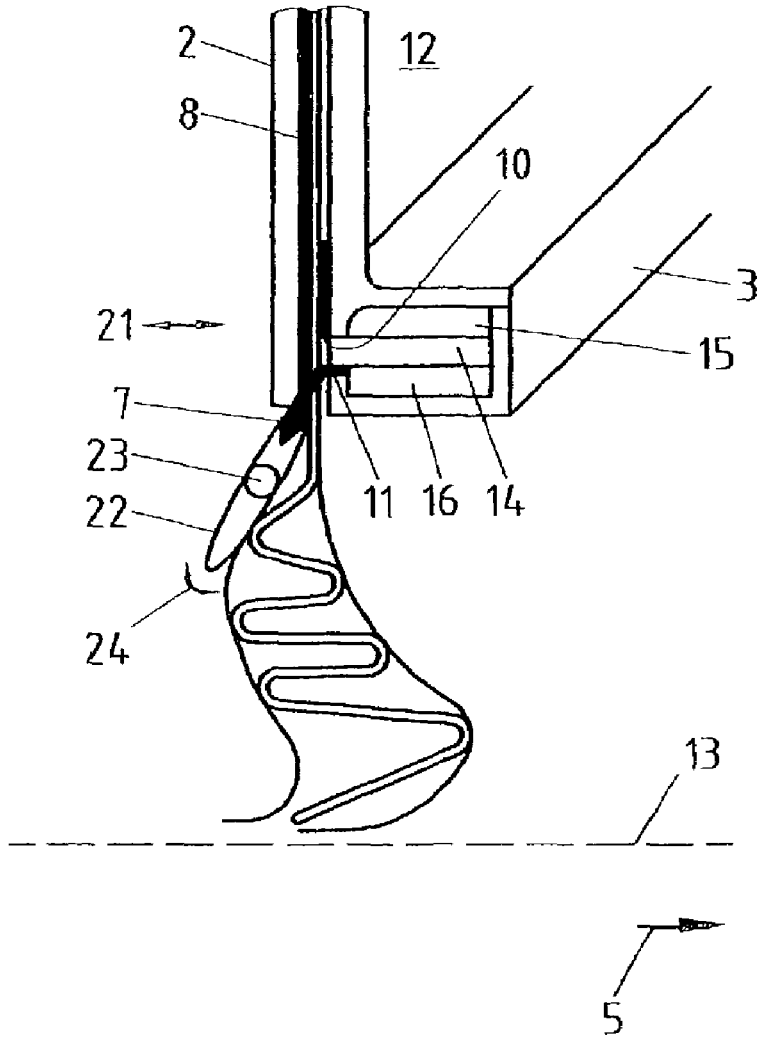
FIG. 4 shows the stretching channel, with the blowing shaft and air feed lines, in a partially perspective view.

FIG. 4 shows a combination of stretching channel 12, blowing shaft 3, and deposit belt 13. Blowing shaft 3 has nozzles 10 and 11, from which air streams 6 and 7 exit. Blowing shaft 3 is divided into two chambers 15 and 16 by sheet-metal partition 14, and compressed air is provided to nozzles 10 and 11 via these chambers. Air guide plate 2 is attached opposite blowing shaft 3, and can be moved in the direction towards blowing shaft 3 via appropriate setting mechanisms, as shown by double arrow 21. Below air guide plate 2, flap 22 is provided, which can be pivoted around axis 23, as indicated by arrow 24. Filament sheet 8 that exits from stretching channel 12 is moved laterally, crosswise back and forth by the air streams from air exit nozzles 10 and 11. Filament sheet 8 is additionally moved back and forth in the production direction by flap 22. The nonwoven fabric that forms on deposit belt 13 has an unusually high degree of uniformity and a uniform surface weight distribution.

Figure 5:
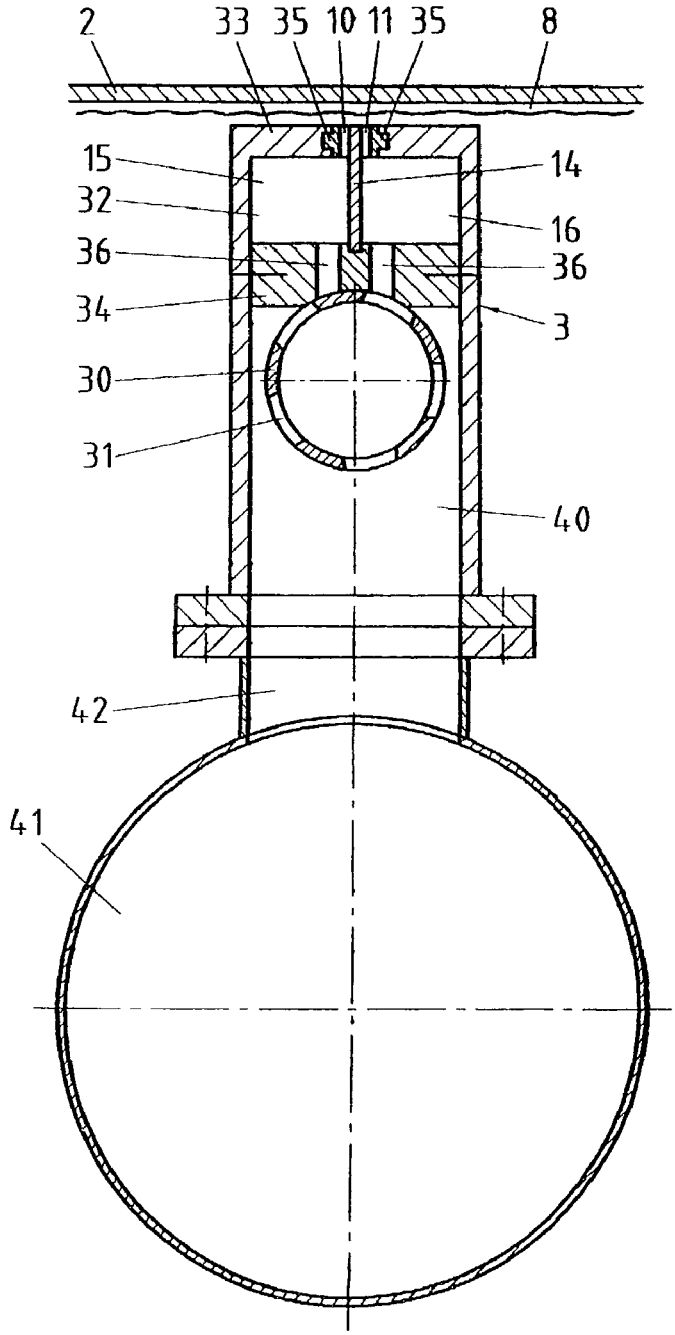
FIG. 5 shows the blowing shaft with an air storage chamber.

FIG. 5 shows the preferred embodiment, in which roller 30, which is hollow and provided with slits 31, is arranged in blowing shaft 3 in a separate lengthwise channel 40. Between nozzle wall 33 of blowing shaft 3 and a sealing wall 34, against which roller 30 rests, there is an air storage chamber 32, which is divided into two chambers 15 and 16 by sheet-metal partition 14. Nozzles 10 and 11 are arranged in rows, one above the other, in nozzle wall 33. They are formed by inserts 5 in the form of corrugated sheet metal, with corrugations that run at a slant to their lengthwise direction (to the machine width). Inserts 35 are replaceable. Sealing wall 34 has lengthwise slits 36 that lie above one another, which correspond to lengthwise slits 31 in roller 30. Lengthwise slits 31 and 36 are coordinated with one another in such a way that the compressed air is supplied either only to upper chamber 15 or only to lower chamber 16. In this connection, air-free breaks can be made, by covering slits 36 with the roller wall. The air flow from lengthwise channel 40 into chambers 15 and 16 can be varied as a function of the ratio between lengthwise slits 31 and the roller wall, and slits 36 in sealing wall 34. Lengthwise channel 40 is connected with a compressed air reservoir 41 that extends parallel to lengthwise channel 40, by way of several connector taps 42.

What is claimed is:

1. A method for the production of a spunbonded nonwoven fabric, comprising spinning a linear filament sheet of filaments arranged parallel next to one another laterally crosswise to a production direction, in the form of a curtain, from a plurality of spinning capillaries, with aerodynamic take-off and stretching of the filament sheet, wherein the filament sheet (8) which exits from a stretching channel (12) or which is drawn off a spool is moved laterally, crosswise, by an air stream from a blowing shaft one of in front of and behind a plane of the filament sheet (8), said air stream having periodically changing directions applied alternately and aligned at a slant to the filament sheet (8), seen in the horizontal plane.

2. The method for the production of a spunbonded nonwoven fabric according to claim 1, wherein air-free breaks occur between the air flows.

3. The method for the production of a spunbonded nonwoven fabric according to claim 1, wherein a blowing angle is 15° in the horizontal plane.

4. The method for the production of a spunbonded nonwoven fabric according to claim 3, wherein a blowing direction in the vertical plane is directed at a slant downwards onto the filament sheet (8).

5. The method for the production of a spunbonded nonwoven fabric according to claim 4, wherein a blowing angle is 15° in the vertical plane.

6. The method for the production of a spunbonded nonwoven fabric according to claim 1, wherein the filament sheet (8) is additionally deflected by periodically moved flow guide surfaces.

7. A method for the production of a spunbonded nonwoven fabric, comprising spinning fibers drawn out of a plurality of spinning capillaries, using a melt-blown spinning process, in a plane, downward laterally crosswise to a production direction, in the form of a curtain, wherein the fibers (8) are moved laterally, crosswise, by an air stream from a blowing shaft one of in front of and behind a plane of the filament sheet (8), said air stream having periodically changing directions applied alternately and aligned at a slant to the fibers (8), seen in the horizontal plane.

8. The method for the production of a spunbonded nonwoven fabric according to claim 7, wherein air-free breaks occur between the air flows.

9. The method for the production of a spunbonded nonwoven fabric according to claim 7, wherein a blowing angle is 15° in the horizontal plane.

10. The method for the production of a spunbonded nonwoven fabric according to claim 9, wherein a blowing direction in the vertical plane is directed at a slant downwards onto the fibers (8).

11. A method for the production of a spunbonded nonwoven fabric comprising spinning a linear filament sheet of filaments arranged parallel next to one another laterally crosswise to a production direction, in the form of a curtain, from a plurality of spinning capillaries, with aerodynamic take-off and stretching of the filament sheet, wherein the filament sheet (8) which exits from a stretching channel (12) or which is drawn off a spool is moved laterally, crosswise, by an air stream from a blowing shaft one of in front of and behind a plane of the filament sheet (8), said air stream having periodically changing directions applied alternately to the filament sheet (8), seen in the horizontal plane;

wherein the blowing direction is directed perpendicular onto the filament sheet (8).

12. A method for the production of a spunbonded nonwoven fabric comprising spinning fibers drawn out of a plurality of spinning capillaries, using a melt-blown spinning process, in a plane, downward laterally crosswise to a production direction, in the form of a curtain, wherein the fibers (8) are moved laterally, crosswise, by an air stream from a blowing shaft one of in front of and behind a plane of the filament sheet (8), said air stream having periodically changing directions applied alternately to the fibers (8), seen in the horizontal plane;

wherein the blowing direction is directed perpendicular onto the fibers (8).

13. A method for the production of a spunbonded nonwoven fabric, comprising spinning a linear filament sheet of filaments arranged parallel next to one another laterally crosswise to a production direction, in the form of a curtain, from a plurality of spinning capillaries, with aerodynamic take-off and stretching of the filament sheet, wherein the filament sheet (8) which exits from a stretching channel (12) or which is drawn off a spool is moved laterally, crosswise, by an air stream from a blowing shaft one of in front of and behind a plane of the filament sheet (8), said air stream having periodically changing directions applied alternately and aligned at a slant to the filament sheet (8), seen in the horizontal plane;

wherein the air stream is directed onto the filament sheet (8) from the front or from the rear of same.

* * * * *